US008505632B2

(12) United States Patent
Guerrero et al.

(10) Patent No.: US 8,505,632 B2
(45) **Date of Patent: *Aug. 13, 2013**

(54) METHOD AND APPARATUS FOR DEPLOYING AND USING SELF-LOCATING DOWNHOLE DEVICES

(75) Inventors: Julio Guerrero, Cambridge, MA (US); Gary L. Rytlewski, League City, TX (US); Bruno Lecerf, Novosibirsk (RU); Michael J. Bertoja, Pearland, TX (US); Christian Ibeagha, Missouri City, TX (US); Alex Moody-Stuart, London (GB); Adam Mooney, Missouri City, TX (US); Jay Russell, Issy-les-Moulineaux (FR); Christopher Hopkins, Paris (FR); Adam Paxson, Boston, MA (US); Billy Anthony, Missouri City, TX (US); Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/112,512

(22) Filed: May 20, 2011

(65) Prior Publication Data

US 2012/0085538 A1 Apr. 12, 2012

Related U.S. Application Data

(63) Continuation-in-part of application No. 12/945,186, filed on Nov. 12, 2010, and a continuation of application No. 11/834,869, filed on Aug. 7, 2007, now abandoned.

(60) Provisional application No. 61/347,360, filed on May 21, 2010.

(51) Int. Cl.
*E21B 34/14* (2006.01)

(52) U.S. Cl.
USPC ..... 166/373; 166/386; 166/318; 166/332.4

(58) Field of Classification Search
USPC ..... 166/373, 313, 386, 332.4, 193, 194, 166/254.1, 318, 254.18
See application file for complete search history.

(56) References Cited

U.S. PATENT DOCUMENTS 2,223,442 A 12/1940 Crowell
2,374,169 A 4/1945 Boyton (Continued)

FOREIGN PATENT DOCUMENTS

GB 2375558 A 11/2002
GB 2386624 A 9/2003

(Continued)

OTHER PUBLICATIONS

McDaniel, B. W., "Review of Current Fracture Stimulation Techniques for Best Economics in Multilayer, Lower-Permeability Reservoirs", SPE 98025, Presented at SPE Regional Meeting Sep. 14-16, 2005, Morgantown, WV, USA.

(Continued)

*Primary Examiner* — David Andrews
(74) *Attorney, Agent, or Firm* — Jeffery R. Peterson; Brandon Clark

(57) ABSTRACT

A technique that is usable with a well includes deploying a plurality of location markers in a passageway of the well and deploying an untethered object in the passageway such that the object travels downhole via the passageway. The technique includes using the untethered object to sense proximity of at least some of the location markers as the object travels downhole, and based on the sensing, selectively expand its size to cause the object to become lodged in the passageway near a predetermined location.

22 Claims, 9 Drawing Sheets

(56) References Cited

U.S. PATENT DOCUMENTS 2,429,912 A 10/1947 Baker
2,458,278 A 1/1949 Larkin
2,962,097 A 11/1960 Dollison
3,011,548 A 12/1961 Holt
3,051,243 A 8/1962 Grimmer et al.
3,054,415 A 9/1962 Baker et al.
3,263,752 A * 8/1966 Conrad ..... 166/154
3,269,463 A 8/1966 Page, Jr.
3,270,814 A 9/1966 Richardson et al.
3,285,353 A 11/1966 Young
3,333,635 A 8/1967 Crawford
3,395,758 A 8/1968 Kelly et al.
3,542,127 A 11/1970 Malone
3,741,300 A 6/1973 Wolff et al.
3,768,556 A 10/1973 Baker
3,789,926 A 2/1974 Henley et al.
3,995,692 A 12/1976 Seitz
4,064,937 A 12/1977 Barrington
4,099,563 A 7/1978 Hutchison et al.
4,176,717 A 12/1979 Hix
4,194,561 A 3/1980 Stokley et al.
4,246,968 A 1/1981 Jessup et al.
4,355,686 A 10/1982 Arendt et al.
4,429,747 A 2/1984 Williamson, Jr.
4,444,266 A 4/1984 Pringle
4,520,870 A 6/1985 Pringle
4,709,760 A 12/1987 Crist et al.
4,729,432 A 3/1988 Helms
4,771,831 A 9/1988 Pringle et al.
4,813,481 A 3/1989 Sproul et al.
4,880,059 A 11/1989 Brandell et al.
4,949,788 A 8/1990 Szarka et al.
4,967,841 A 11/1990 Murray
4,991,654 A 2/1991 Brandell et al.
5,029,644 A 7/1991 Szarka et al.
5,048,611 A 9/1991 Cochran
5,183,114 A 2/1993 Mashaw, Jr. et al.
5,203,412 A 4/1993 Doggett
5,224,044 A 6/1993 Tamura et al.
5,224,556 A 7/1993 Wilson et al.
5,242,022 A 9/1993 Burton et al.
5,295,393 A 3/1994 Thiercelin
5,333,692 A 8/1994 Baugh et al.
5,337,808 A 8/1994 Graham
5,361,856 A 11/1994 Surjaatmadja et al.
5,368,098 A 11/1994 Blizzard, Jr. et al.
5,375,661 A 12/1994 Daneshy et al.
5,381,862 A 1/1995 Szarka et al.
5,394,941 A 3/1995 Venditto et al.
5,413,173 A 5/1995 Mills et al.
5,513,703 A 5/1996 Mills et al.
5,526,888 A * 6/1996 Gazewood ..... 175/320
5,579,844 A 12/1996 Rebardi et al.
5,598,890 A 2/1997 Richard et al.
5,609,204 A 3/1997 Rebardi et al.
5,660,232 A 8/1997 Reinhardt
5,765,642 A 6/1998 Surjaatmadja
5,848,646 A 12/1998 Huber et al.
5,887,657 A 3/1999 Bussear et al.
5,921,318 A 7/1999 Ross
5,988,285 A 11/1999 Tucker et al.
6,006,838 A 12/1999 Whiteley et al.
6,009,947 A 1/2000 Wilson et al.
6,059,032 A 5/2000 Jones
6,109,372 A 8/2000 Dorel et al.
6,155,342 A 12/2000 Oneal et al.
6,186,230 B1 2/2001 Nierode
6,206,095 B1 3/2001 Baugh
6,216,785 B1 4/2001 Achee, Jr. et al.
6,220,357 B1 4/2001 Carmichael et al.
6,253,861 B1 7/2001 Carmichael et al.
6,286,599 B1 9/2001 Surjaatmadja et al.
6,302,199 B1 10/2001 Hawkins et al.
6,333,699 B1 12/2001 Zierolf
6,334,486 B1 1/2002 Carmody et al.
6,371,208 B1 4/2002 Norman et al.
6,386,288 B1 5/2002 Snider et al.
6,394,184 B2 5/2002 Tolman et al.
6,443,228 B1 9/2002 Aronstam et al.
6,464,006 B2 10/2002 Womble
6,513,595 B1 2/2003 Freiheit et al.
6,520,255 B2 2/2003 Tolman et al.
6,536,524 B1 3/2003 Snider
6,543,538 B2 4/2003 Tolman et al.
6,575,247 B2 6/2003 Tolman et al.
6,634,429 B2 10/2003 Henderson et al.
6,644,412 B2 11/2003 Bode et al.
6,662,874 B2 12/2003 Surjaatmadja et al.
6,672,405 B2 1/2004 Tolman et al.
6,675,891 B2 1/2004 Hailey, Jr. et al.
6,719,051 B2 4/2004 Hailey, Jr. et al.
6,719,054 B2 4/2004 Cheng et al.
6,725,933 B2 4/2004 Middaugh et al.
6,759,968 B2 7/2004 Zierolf
6,761,219 B2 7/2004 Snider et al.
6,880,638 B2 4/2005 Haughom et al.
6,907,936 B2 6/2005 Fehr et al.
6,951,331 B2 10/2005 Haughom et al.
6,994,170 B2 2/2006 Echols
6,997,263 B2 2/2006 Campbell et al.
7,021,384 B2 4/2006 Themig
7,066,264 B2 6/2006 Bissonnette et al.
7,066,265 B2 6/2006 Surjaatmadja
7,093,664 B2 8/2006 Todd et al.
7,096,945 B2 8/2006 Richards et al.
7,108,067 B2 9/2006 Themig et al.
7,128,152 B2 10/2006 Anyan et al.
7,128,160 B2 10/2006 Anyan et al.
7,134,505 B2 11/2006 Fehr et al.
7,168,494 B2 1/2007 Starr et al.
7,191,833 B2 3/2007 Richards
7,210,533 B2 5/2007 Starr et al.
7,322,417 B2 1/2008 Rytlewski
7,325,616 B2 2/2008 Lopez de Cardenas et al.
7,325,617 B2 2/2008 Murray
7,353,879 B2 4/2008 Todd et al.
7,377,321 B2 5/2008 Rytlewski
7,387,165 B2 6/2008 Lopez de Cardenas et al.
7,431,091 B2 10/2008 Themig et al.
7,464,764 B2 12/2008 Xu
7,490,669 B2 2/2009 Walker et al.
7,543,634 B2 6/2009 Fehr et al.
7,543,647 B2 6/2009 Walker
7,552,779 B2 6/2009 Murray
7,571,765 B2 8/2009 Themig
7,575,062 B2 8/2009 East, Jr.
7,661,481 B2 2/2010 Todd et al.
7,748,460 B2 7/2010 Themig et al.
7,832,472 B2 11/2010 Themig
7,832,488 B2 11/2010 Guerrero et al.
7,891,774 B2 2/2011 Silverbrook
7,896,088 B2 3/2011 Guerrero et al.
2002/0007949 A1 1/2002 Tolman et al.
2002/0049575 A1 4/2002 Jalali et al.
2002/0093431 A1 7/2002 Zierolf
2002/0157837 A1 10/2002 Bode et al.
2002/0158120 A1 10/2002 Zierolf
2002/0166665 A1 11/2002 Vincent et al.
2003/0019634 A1 1/2003 Henderson et al.
2003/0070809 A1 4/2003 Schultz et al.
2003/0070811 A1 4/2003 Robison et al.
2003/0090390 A1 5/2003 Snider et al.
2003/0111224 A1 6/2003 Hailey, Jr. et al.
2003/0127227 A1 7/2003 Fehr et al.
2003/0136562 A1 7/2003 Robison et al.
2003/0180094 A1 9/2003 Madison
2003/0188871 A1 10/2003 Dusterhoft et al.
2003/0234104 A1 12/2003 Johnston et al.
2004/0020652 A1 2/2004 Campbell et al.
2004/0040707 A1 3/2004 Dusterhoft et al.
2004/0050551 A1 3/2004 Jones
2004/0055749 A1 3/2004 Lonnes et al.
2004/0084189 A1 5/2004 Hosie et al.
2004/0092404 A1 5/2004 Murray et al.

| | | | |
|---|---|---|---|
| 2004/0118564 | A1 | 6/2004 | Themig et al. |
| 2004/0129422 | A1 | 7/2004 | Themig |
| 2004/0231840 | A1 | 11/2004 | Ratanasirigulchai et al. |
| 2004/0238168 | A1 | 12/2004 | Echols |
| 2004/0262016 | A1 | 12/2004 | Farquhar |
| 2005/0178552 | A1 | 8/2005 | Fehr et al. |
| 2005/0230118 | A1 | 10/2005 | Noske et al. |
| 2006/0076133 | A1 | 4/2006 | Penno |
| 2006/0086497 | A1 | 4/2006 | Ohmer et al. |
| 2006/0090893 | A1 | 5/2006 | Sheffield |
| 2006/0090906 | A1 | 5/2006 | Themig |
| 2006/0108110 | A1 | 5/2006 | McKeen |
| 2006/0124310 | A1 | 6/2006 | Lopez de Cardenas et al. |
| 2006/0124311 | A1 | 6/2006 | Lopez de Cardenas et al. |
| 2006/0124312 | A1 | 6/2006 | Rytlewski et al. |
| 2006/0124315 | A1 | 6/2006 | Frazier et al. |
| 2006/0144590 | A1 | 7/2006 | Lopez de Cardenas et al. |
| 2006/0157255 | A1 | 7/2006 | Smith |
| 2006/0207763 | A1 | 9/2006 | Hofman |
| 2006/0207764 | A1 | 9/2006 | Rytlewski |
| 2006/0207765 | A1 | 9/2006 | Hofman |
| 2006/0243455 | A1 | 11/2006 | Telfer et al. |
| 2007/0007007 | A1 | 1/2007 | Themig et al. |
| 2007/0044958 | A1 | 3/2007 | Rytlewski et al. |
| 2007/0084605 | A1 | 4/2007 | Walker et al. |
| 2007/0107908 | A1 | 5/2007 | Vaidya |
| 2007/0151734 | A1 | 7/2007 | Fehr et al. |
| 2007/0181224 | A1 | 8/2007 | Marya et al. |
| 2007/0272411 | A1 | 11/2007 | Lopez de Cardenas |
| 2007/0272413 | A1 | 11/2007 | Rytlewski et al. |
| 2007/0284097 | A1 | 12/2007 | Swor et al. |
| 2008/0000697 | A1 | 1/2008 | Rytlewski |
| 2008/0105438 | A1 | 5/2008 | Jordan et al. |
| 2008/0210429 | A1 | 9/2008 | McMillin et al. |
| 2008/0217021 | A1 | 9/2008 | Lembcke et al. |
| 2009/0084553 | A1 | 4/2009 | Rytlewski et al. |
| 2009/0158674 | A1 | 6/2009 | Guerrero et al. |
| 2010/0065276 | A1 | 3/2010 | Fehr et al. |
| 2010/0101803 | A1 | 4/2010 | Clayton et al. |
| 2010/0132954 | A1* | 6/2010 | Telfer ..... 166/373 |
| 2010/0209288 | A1 | 8/2010 | Marya |
| 2010/0243274 | A1 | 9/2010 | Guerrero et al. |
| 2011/0056692 | A1 | 3/2011 | Lopez de Cardenas |
| 2011/0127047 | A1 | 6/2011 | Themig et al. |
| 2011/0278010 | A1 | 11/2011 | Fehr et al. |

FOREIGN PATENT DOCUMENTS

| | | | |
|---|---|---|---|
| GB | 2411189 | A | 8/2005 |
| GB | 2424233 | A | 9/2006 |
| WO | 03095794 | A1 | 11/2003 |
| WO | 2004088091 | A1 | 10/2004 |

OTHER PUBLICATIONS

Lonnes, S. B., Nygaard, K. J., Sorem, W. A., Hall, T. J., Tolman, R. C., "Advanced Multizone Stimulation Technology", SPE 95778, Presented at the 2005 SPE Annual Technical Conference and Exhibition, Oct. 9-12, 2005, Dallas, TX, USA.

Rytlewski, G., "Multiple-Layer Commpletions for Efficient Treatment of Multilayer Reservoirs", IADC/SPE 112476, Presented at the 2008 IADC/SPE Drilling Conference, Mar. 4-6, 2008, Orlando, FL, USA.

Thomson, D. W., and Nazroo, M. F., "Design and Installation of a Cost-Effective Completion System for Horizontal Chalk Wells Where Multiple Zones Require Acid Stimulation", SPE 51177 (a revision of SPE 39150), Offshore Technology Conference, May 1997, Houston, TX, USA.

International Search Report, Application No. PCT/US2011/037387 dated Feb. 9, 2012.

Written Opinion, Application No. PCT/US2011/037387 dated Feb. 9, 2012.

* cited by examiner

METHOD AND APPARATUS FOR DEPLOYING AND USING SELF-LOCATING DOWNHOLE DEVICES

The present application claims the benefit under 35 U.S.C. §119(e) to U.S. Provisional Patent Application Ser. No. 61/347,360, entitled, "MECHANISMS FOR DEPLOYING SELF-LOCATING DOWNHOLE DEVICES," which was filed on May 21, 2010, and is hereby incorporated by reference in its entirety; and the present application is a continuation-in-part of U.S. patent application Ser. No. 12/945,186, entitled, "SYSTEM FOR COMPLETING MULTIPLE WELL INTERVALS," which was filed on Nov. 12, 2010, which is a continuation of U.S. patent application Ser. No. 11/834,869 (now abandoned), entitled, "SYSTEM FOR COMPLETING MULTIPLE WELL INTERVALS," which was filed on Aug. 7, 2007, and is a divisional of U.S. Pat. No. 7,387,165, entitled, "SYSTEM FOR COMPLETING MULTIPLE WELL INTERVALS," which issued on Jun. 17, 2008.

TECHNICAL FIELD

The invention generally relates to a technique and apparatus for deploying and using self-locating downhole devices.

BACKGROUND

For purposes of preparing a well for the production of oil or gas, at least one perforating gun may be deployed into the well via a deployment mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. All of these operations typically are multiple stage operations, which means that the operation involves isolating a particular zone, or stage, of the well, performing the operation and then proceeding to the next stage. Typically, a multiple stage operation involves several runs, or trips, into the well.

Each trip into a well involves considerable cost and time. Therefore, the overall cost and time associated with a multiple stage operation typically is a direct function of the number of trips into the well used to complete the operation.

SUMMARY

In an embodiment of the invention, a technique that is usable with a well includes deploying a plurality of location markers in a passageway of the well and deploying an untethered object in the passageway such that the object travels downhole via the passageway. The technique includes using the untethered object to sense proximity to some of a plurality of location markers as the object travels downhole and based on the sensing, selectively expand its size to cause the object to become lodged in the passageway near a predetermined location.

In another embodiment of the invention, an apparatus that is usable with a well includes a body adapted to travel downhole untethered via a passageway of the well, a blocker, a sensor and a controller. The blocker is adapted to travel downhole with the body, be contracted as the body travels in the passageway, and be selectively radially expanded to lodge the body in the passageway. The sensor is adapted to travel downhole with the body and sense at least some of a plurality of location markers, which are disposed along the passageway as the body travels downhole. The controller is adapted to travel downhole with the body and based on the sensing, control the blocker to cause the blocker to radially expand as the body is traveling to cause the body object to lodge in the passageway near a predetermined location.

In yet another embodiment of the invention, a system that usable with a well includes a casing string, a plurality of location markers and a plug. The casing string is adapted to support a wellbore of the well and includes a passageway. The locations markers are deployed along the passageway. The plug travels downhole untethered via the passageway and is adapted to sense proximity to at least one of the location markers as the plug travels downhole, estimate when the plug is to arrive near a predetermined location in the well based at least in part on the sensing of the location marker(s), and selectively expand its size to cause the plug to become lodged in the passageway near the predetermined location.

Advantages and other features of the invention will become apparent from the following drawing, description and claims.

DETAILED DESCRIPTION

Figure 1:
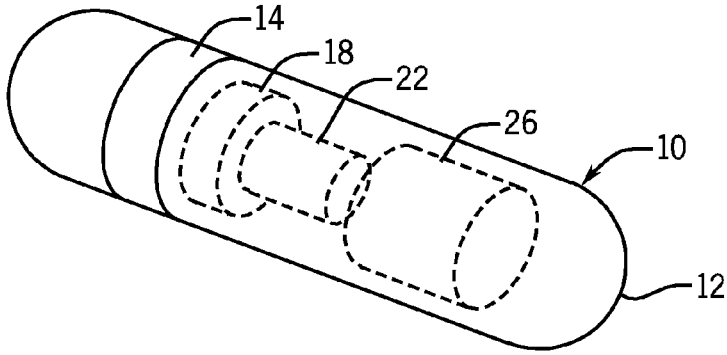
FIG. 1 is a perspective view of a plug that may be deployed in a well according to an embodiment of the invention.

In accordance with embodiments of the invention, systems and techniques are disclosed herein for purposes of autonomously separating two zones inside a cylindrical environment of a well using an untethered dart, or plug 10, which is depicted in FIG. 1. As a non-limiting example, the cylindrical environment may be a particular main or lateral wellbore segment of the well such that the plug 10 may be conveyed downhole via fluid or a fluid flow until the plug 10 is in the desired position or location where the zonal isolation is to occur. In general, the plug 10 has modules, which perform a variety of downhole tasks, such as the following: 1.) autonomously perceiving the location of the plug 10 with respect to the downhole cylindrical environment as the plug 10 is traveling through the downhole environment (via the plug's perception module 26); 2.) autonomously radially expanding to mechanically block and seal off the cylindrical environment at a desired downhole location to separate two zones, including anchoring of the plug 10 in place (via the plug's blocker 14); 3.) autonomously actuating features of the plug 10 to perform the above-described blocking, sealing and anchoring (via the plug's actuation module 18); and 4.) energizing the actuation 18 and perception 26 modules (via the plug's energization module 22). As described further herein, after performing its separation-of-zones task, the plug 10 may, in accordance with some embodiments of the invention, autonomously radially contract to remove the zonal separation, which allows the plug 10 to be flowed in either direction in the well for such purposes as forming zonal isolation at another downhole location or possibly retrieving the plug 10 to the Earth's surface.

As a non-limiting example, in accordance with some embodiments of the invention, the plug's modules 14, 18, 22 and 26 may be contained in a "pill shaped" housing 12 of the plug 10 to facilitate the travel of the plug 10 inside the cylindrical environment. Thus, as depicted in FIG. 1, the housing 12 of the plug 10 may, in general, have rounded ends, facilitating backward and forward movement of the plug throughout the cylindrical environment. In general, in its initial state when deployed into the well, the plug 10 has a cross-sectional area, which is smaller than the cross-sectional area of the cylindrical environment through which the plug 10 travels. In this regard, the cylindrical environment has various passageways into which the plug 10 may be deployed; and the plug 10, in its contracted, or unexpanded state, freely moves through these passageways.

The plug 10, as further described herein, is constructed to autonomously and selectively increase its cross-sectional area by radially expanding its outer profile. This radial expansion blocks further travel of the plug 10 through the cylindrical environment, seals the cylindrical environment to create the zonal isolation and anchors the plug 10 in place.

The expansion and contraction of the plug's cross-sectional area is accomplished through the use of the blocker 14. In this manner, when the plug 10 is in its radially contracted state (i.e., the state of the plug 10 during its initial deployment), the blocker 14 is radially contracted such that the cross-sectional area of the blocker 14 is substantially the same, in general, as the cross-sectional area of the housing 10. The plug 10 is constructed to selectively increase its cross-sectional area by actuating the blocker 14 to expand the blocker's cross-sectional area to allow the blocker 14 to thereby perform the above-described functions of blocking, sealing and anchoring.

In general, the plug 10 increases its cross-sectional area to match the cross-sectional area of the cylindrical environment for purposes of creating zonal isolation at the desired downhole location. Alternatively the plug 10 increases its cross-sectional area to an extend that it in combination with another wellbore element blocks the cross-sectional area of the cylindrical environment for purposes of creating zonal isolation at the desired downhole location (as shown for example in FIG. 4). After zonal isolation is created, one or more operations (perforating, fracturing, stimulation, etc.) may be conducted in the well, which take advantage of the zonal isolation. At the conclusion of the operation(s), it may be desirable to remove the zonal isolation. Although conventionally, a plug is removed via another downhole tool, such as a plug removal tool or drill, which may require another trip into the well, the plug 10 is constructed to autonomously undertake measures to facilitate its removal.

More specifically, in accordance with some embodiments of the invention, when the zonal isolation provided by plug 10 is no longer needed, the plug 10 may cause the blocker 14 to radially contract so that the plug 10 may once again move freely through the cylindrical environment. This permits the plug 10 to, as non-limiting examples, be flowed to another stage of the well to form zonal isolation at another downhole location, be flowed or otherwise fall downwardly in the well without forming further isolations, or be retrieved from the well. Alternatively, the plug 10 may remain in place and be removed by another downhole tool, such as a milling head or a plug removal tool, depending on the particular embodiment of the invention.

The plug 10 radially expands the blocker 14 in a controlled manner for purposes of landing the plug 10 in the desired location of the well. The perception module 26 allows the plug 10 to sense its location inside the cylindrical environment so that the plug 10 may cause the blocker 14 to expand at the appropriate time. In general, the perception module 26 may be hardware circuitry-based, may be a combination of hardware circuitry and software, etc. Regardless of the particular implementation, the perception module 26 senses the location of the plug 10 in the cylindrical environment, as well as possibly one or more properties of the plug's movement (such as velocity, for example), as the plug 10 travels through the cylindrical environment.

Based on these gathered parameters, the perception module 26 interacts with the actuation module 18 of the plug 10 to selectively radially expand the blocker 14 for purposes of creating the zonal isolation at the desired location in the well. In general, the actuation module 18 may include a motor, such as an electrical or hydraulic motor, which actuates the blocker 14, as further described below. The power to drive this actuation is supplied by the energization module 22, which may be a battery, a hydraulic source, a fuel cell, etc., depending on the particular implementation. The power to actuate can be hydrostatic pressure. The signal to actuate would release hydrostatic pressure (via electric rupture disc as an example) in to enter a chamber that was at a lower pressure.

Figure 2:
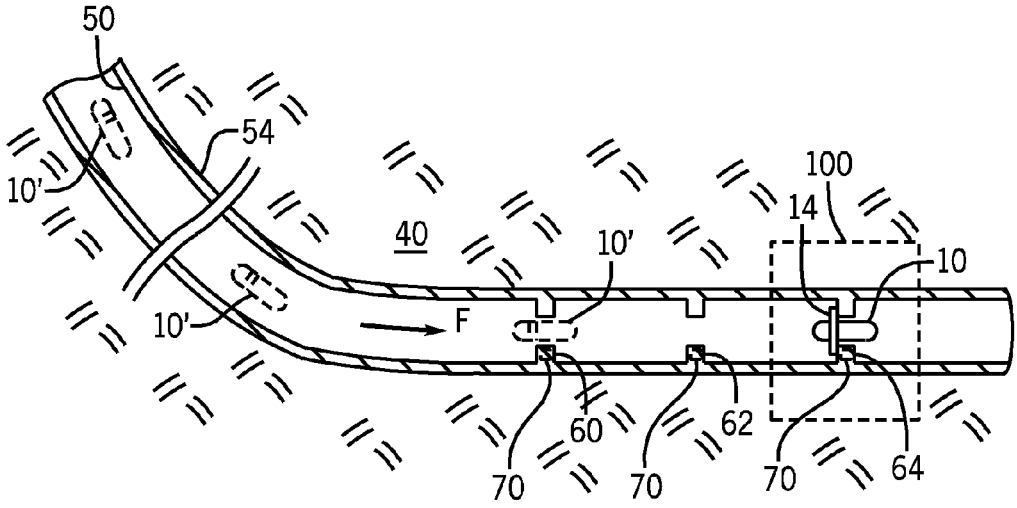
FIG. 2 is an illustration of a wellbore depicting deployment of the plug of FIG. 1 in the wellbore according to an embodiment of the invention.

In accordance with some embodiments of the invention, the plug 10 determines its downhole position by sensing proximity of the plug 10 to landmarks, or locations markers, which are spatially distributed in the well at various locations in the cylindrical environment. As a more specific example, FIG. 2 depicts an exemplary cylindrical environment in which the plug 10 may be deployed, in accordance with some embodiments of the invention. It is noted that this environment may be part of a land-based well or a subsea well, depending on the particular implementation. For this example, the cylindrical environment is formed from a casing string 54 that, in general, lines and supports a wellbore 50 that extends through a surrounding formation 40. The casing string 54, in general, defines an interior passageway through which the plug 10 may pass in a relatively unobstructed manner when the plug 10 is in its contracted, or unexpanded state. Alternatively embodiments of the invention may be used in an uncased wellbore environment.

In general, the FIG. 2 depicts the use of a flow F (created by a surface pump, for example) to move the plug 10 toward the heel of the illustrated wellbore 50. In FIG. 2, the reference numeral "10'" is used to depict the various positions of the plug 10 along its path inside the casing string 54. For this particular example, to allow the plug 10 to autonomously determine its position as well as one or more propagation characteristics associated with the movement of the plug 10, the casing string 54 includes exemplary location markers 60, 62 and 64.

Each location marker 60, 62 and 64 for this example introduces a cross-sectional restriction through which the plug 10 is sized to pass through, if the blocker 14 is in its retracted state. When the blocker 14 of the plug 10 radially expands, the plug's cross section is larger than the cross section of the marker's restriction, thereby causing the plug 10 to become lodged in the restriction. It is noted that the restrictions may be spatially separate from the location markers, in accordance with other embodiments of the invention.

In general, the perception module 26 of the plug 10 senses the location markers 60, 62 and 64, as the plug 10 approaches and passes the markers on the plug's journey through the passageway of the casing string 54. By sensing when the plug 10 is near one of the location markers, the plug 10 is able to determine the current position of the plug 10, as well as one or more propagation characteristics of the plug 10, such as the plug's velocity. In this manner, the distance between two location markers may be known. Therefore, the plug 10 may be able to track its position versus time, which allows the plug 10 to determine its velocity, acceleration, etc. Based on this information, the plug 10 is constructed to estimate an arrival time at the desired position of the well at which the zonal isolation is to be created. Alternatively, plug 10 expands immediately when sensing a signal just above landing in restriction in 64.

For the example that is illustrated in FIG. 2, the plug 10 creates the zonal isolation at location marker 64. Therefore, as a non-limiting example, the plug 10 may, when passing near and by upstream location markers, such as location markers 60 and 62, develop and refine an estimate of the time at which the plug 10 is expected to arrive at the location marker 64. Based on this estimate, the plug 10 actuates the blocker 14 at the appropriate time such that the plug 10 passes through the markers upstream of the location marker 64 while lodging in the restriction created at the location marker 64. Thus, for this example, the plug 10 may begin expanding the blocker 14 after the plug 10 passes through the landmark 60 while still retaining a sufficiently small cross-sectional area to allow the plug 10 to pass through the location marker 62. After passage through the location marker 62, the plug 10 completes the radial expansion of the blocker 14 so that the plug 10 is captured by the restriction in the location marker 64.

Figure 3:
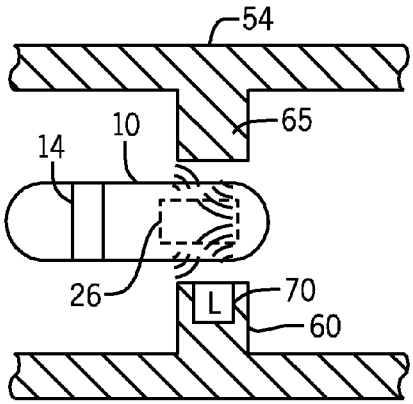
FIG. 3 is an illustration of the plug of FIG. 1 approaching a location marker disposed along a passageway through which the plug travels according to an embodiment of the invention.

Referring to FIG. 3 in conjunction with FIGS. 1 and 2, in accordance with some embodiments of the invention, the perception module 26 includes a radio frequency identification (RFID) reader, which transmits radio frequency (RF) signals for purposes of interrogating RFID tags 70 that are embedded in the location markers. In accordance with some embodiments of the invention, each RFID tag stores data indicative of an ID for the tag, which is different from the IDs of the other tags (i.e., each ID is unique with respect to the other IDs). Therefore, through the use of the different IDs, the plug 10 is able to identify a specific location marker and as such, identify the plug's location in the well.

Figure 4:
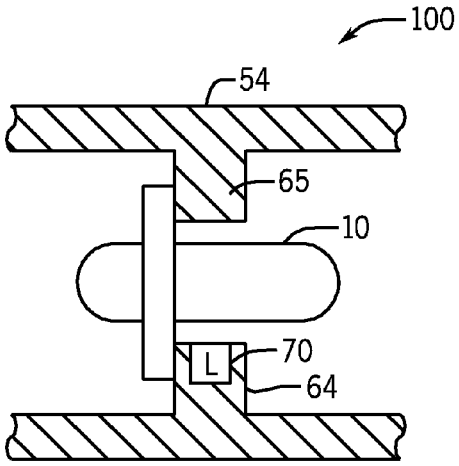
FIG. 4 is a more detailed view of a section of the wellbore of FIG. 2 depicting the plug when lodged in a passageway of the wellbore according to an embodiment of the invention.

Thus, the interrogation that is performed by the RFID reader permits the plug 10 to determine when the plug 10 passes in proximity to a given location marker, such as the location marker 60 depicted in FIG. 3. Based on the sensing of location markers as the plug 10 passes through the markers, the plug 10 determines when to selectively expand the blocker 14 to permit capture of the plug 10 in a restriction 65 of the location marker 64, as depicted in FIG. 4 (which shows a more detailed view of section 100 of FIG. 2).

Other types of sensors and sensing systems (acoustic, optical, etc.) may be used, in accordance with some embodiments of the invention, for purposes of allowing the plug 10 to sense proximity to location markers in the well.

Referring back to FIG. 2, operations may be conducted in the well after the plug lodges itself in the well at the location marker 64. These operations, in general, include operations that involve pressurizing the passageway of the casing 54 above the lodged plug 10. As described further below, exemplary operations include operations to control the open and closed states of a valve, operations to stimulate the well, operations to perform hydraulic fracturing, operations to communicate chemicals into the well, operations to fire a perforating gun assembly, etc. Moreover, due to the ability of the plug 10 to radially expand and contract again and again, the plug 10 may be reused to create additional zonal isolations and thereby allow additional operations to be conducted, without retrieving the plug 10 from the well.

Figure 5:
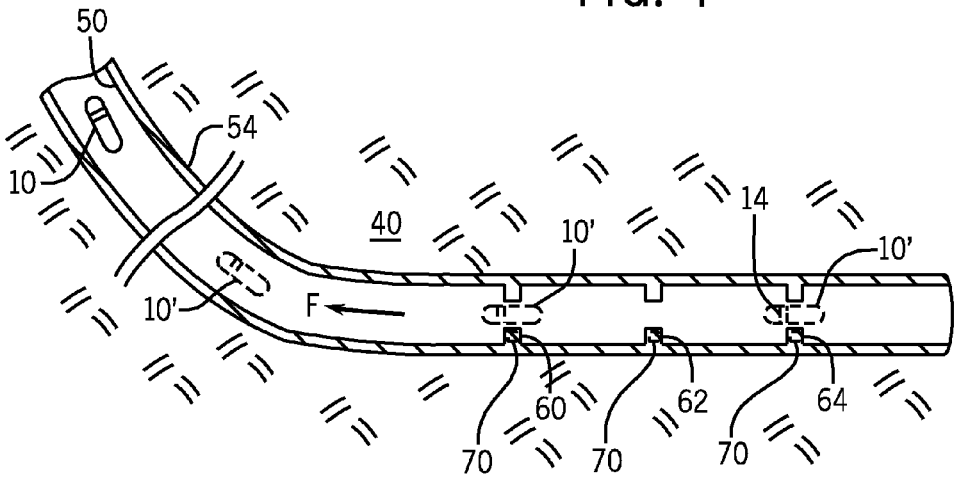
FIG. 5 is an illustration of the wellbore depicting retrieval of the plug according to an embodiment of the invention.

Referring to FIG. 5, when the zonal isolation that is provided by the radially expanded plug 10 is no longer needed, the plug 10 retracts its cross-sectional area by actuating the blocker 14 in a manner that retracts the cross-sectional area of the plug 10 to allow the plug 10 to be reverse flowed out of the well using a reverse flow F, as depicted in FIG. 5. Alternatively, the plug 10 may be flowed, or otherwise fall, further into the well upon retracting its cross-sectional area, in accordance with other embodiments of the invention. Moreover, in accordance with yet other embodiments of the invention, another type of system, such as a milling system, may be used to mill out the obstructed plug 10. For example, for these embodiments of the invention, the housing 12 of the plug 10 may be constructed from a material, which is easily milled by a milling system that is run downhole inside the casing string 54. Other variations are contemplated and are within the scope of the appended claims.

Figure 6:
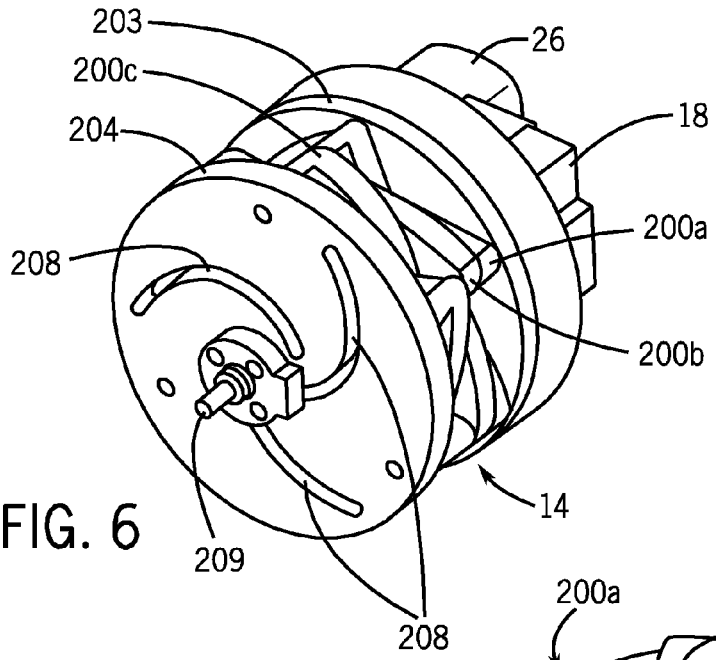
FIG. 6 is a perspective view of a portion of the plug illustrating a blocker of the plug according to an embodiment of the invention.

FIG. 6 depicts a perspective view of a portion of the plug, illustrating the blocker 14 in accordance with some embodiments of the invention. For this example, the blocker 14 three layers 200*a*, 200*b* and 200*c* that circumscribe the longitudinal axis of the plug 10. Referring to FIG. 7B in conjunction with FIG. 6, the layers 200*a* and 200*c* are angularly aligned with respect to each other about the longitudinal axis; and the layer 200*b*, which is disposed between the layers 200*a* and 200*c*, is rotated by 180 degrees about the transverse axis (i.e., is "flipped over") relative to the layers 200*a* and 200*c*. The layers 200*a*, 200*b* and 200*c* are, in general, disposed between two plates 203 and 204 of the blocker 14. As an example, the plate 203 may be fixed in position relative to the actuation module 18. The other plate 204, in turn, may be coupled to a shaft 209 that is rotated by the actuation module 18 in the appropriate clockwise or counterclockwise direction to retract or expand the blocker 14.

Figure 7A:
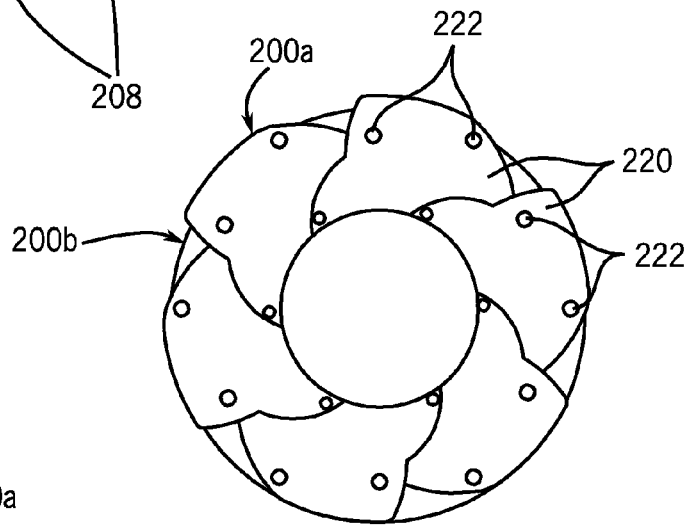
FIG. 7A is an illustration of a top view of the blocker of FIG. 6 in its radially expanded state according to an embodiment of the invention.
Figure 7B:
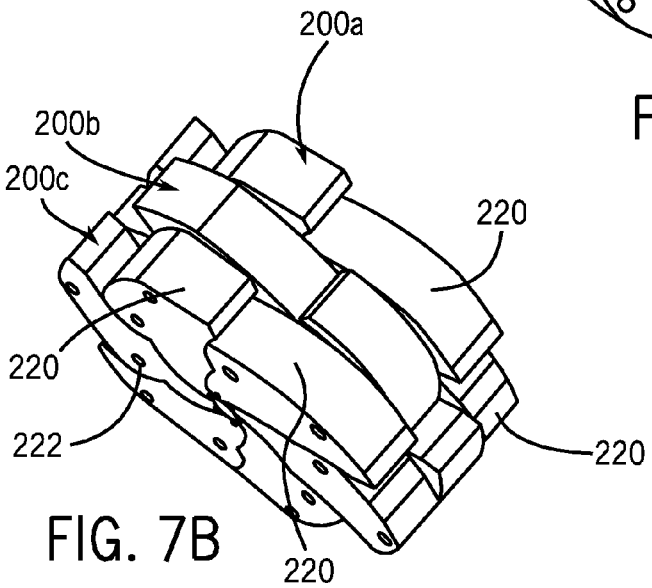
FIG. 7B is a perspective view of the blocker of FIG. 6 in its radially contracted state according to an embodiment of the invention.

Referring to FIG. 7A in conjunction with FIGS. 6 and 7B, in accordance with some embodiments of the invention, pins 222 attach fingers 220 (which may each be constructed from an elastomeric material, as a non-limiting example) of each layer 200 to the plate 203. In this manner, some of the pins 222 pivotably attach fingers 200 of the layers 200*a*, 200*b* and 200*c* together, and other pins 222 slidably attach the fingers 200 of the layers 200*a*, 200*b* and 200*c* to spirally-extending grooves 208 of the plate 204. When the blocker 14 is initially deployed downhole in its radially contracted state, the fingers 220 are radially contracted, as depicted in FIG. 7B. In accordance with an example implementation, because pins 222 reside in the grooves 208 of the turning plate 204, the fingers 220 may be radially expanded (see FIG. 7A) and radially contracted (see FIG. 7B), depending on whether the actuation module 18 turns the shaft 209 in a clockwise or counterclockwise direction.

In accordance with other embodiments of the invention, the blocker 14 may be replaced with a compliant mechanism, such as the one described in U.S. Pat. No. 7,832,488, entitled, "ANCHORING SYSTEM AND METHOD," which issued on Nov. 16, 2010, and is hereby incorporated by reference in its entirety. In other embodiments of the invention, the blocker 14 may be replaced with a deployable structure similar to one of the deployable structures disclosed in U.S. Pat. No. 7,896,088, entitled, "WELLSITE SYSTEMS UTILIZING DEPLOYABLE STRUCTURE," which issued on Mar. 1, 2011, and is hereby incorporated by reference in its entirety; U.S. Patent Application Publication No. US 2009/0158674, entitled, "SYSTEM AND METHODS FOR ACTUATING REVERSIBLY EXPANDABLE STRUCTURES," which was published on Jun. 25, 2009, and is hereby incorporated by reference in its entirety; and U.S. Patent Application Publication No. US 2010/0243274, entitled, "EXPANDABLE STRUCTURE FOR DEPLOYMENT IN A WELL," which was published on Sep. 30, 2010, and is hereby incorporated by reference in its entirety.

Figure 8:
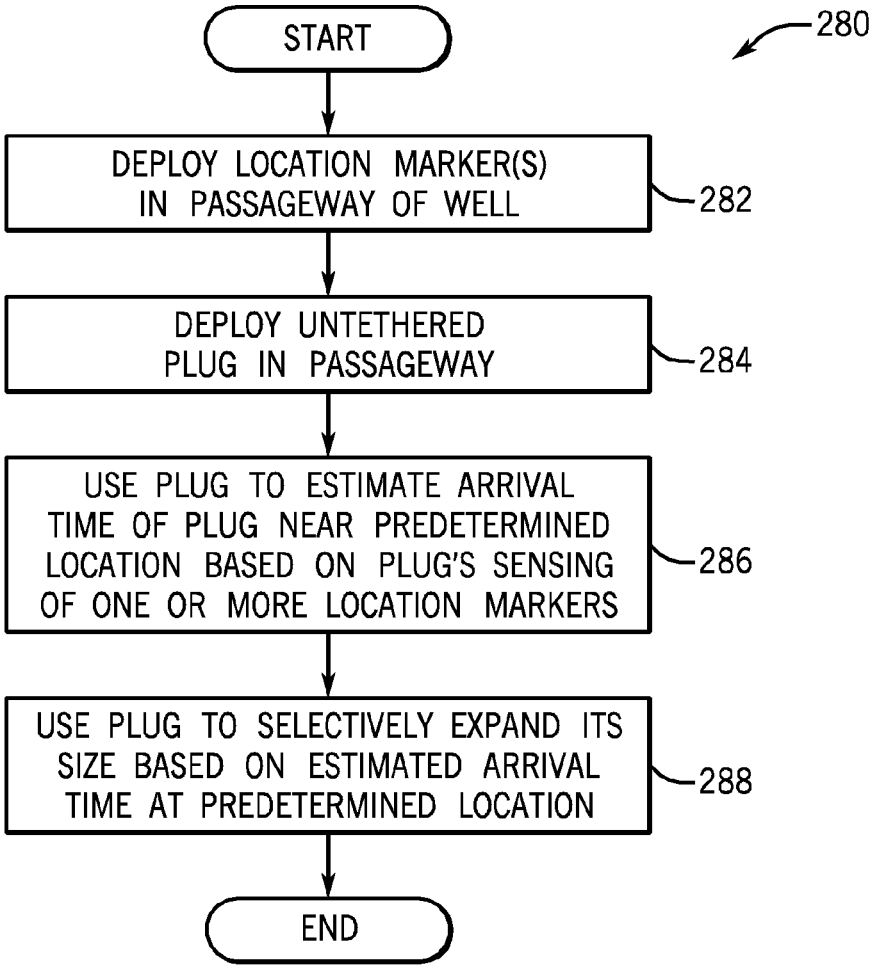
FIG. 8 is a flow diagram depicting a technique to deploy and use an untethered plug in a well according to an embodiment of the invention.

Referring to FIG. 8, thus, in general, a technique 280 may be used to deploy an untethered autonomous plug in a well for purposes of creating zonal isolation at a particular desired location in the well. Pursuant to the technique 280, one or more location markers are deployed in a passageway of the well, pursuant to block 282. The untethered plug may then be deployed, pursuant to block 284 in a given passageway of the well. The plug is used to estimate (block 286) the arrival time of the plug near a predetermined location in the well based on the plug's sensing of one or more of the location markers. The plug is then used, pursuant to block 288, to selectively expand its size based on the estimated arrival time to become lodged near the predetermined location. Location markers may be assembled to the casing string at surface prior to running the casing string into the ground, in accordance with exemplary implementations In accordance with some embodiments of the invention, the plug 10 remains in its radially expanded state for a predetermined time interval for purposes of allowing one or more desired operations to be conducted in the well, which take advantage of the zonal isolation established by the radially expanded plug 10. In this manner, in accordance with some embodiments of the invention, the plug 10 autonomously measures the time interval for creating the zonal isolation. More specifically, the plug 10 may contain a timer (a hardware timer or a software timer, as examples) that the plug 10 activates, or initializes, after the plug 10 radial expands the blocker 10. The timer measures a time interval and generates an alarm at the end of the measured time interval, which causes the plug 10 radially contract the blocker 14, for purposes of permitting the retrieval of the plug 10 or the further deployment and possible reuse of the plug 10 at another location.

Figure 9:
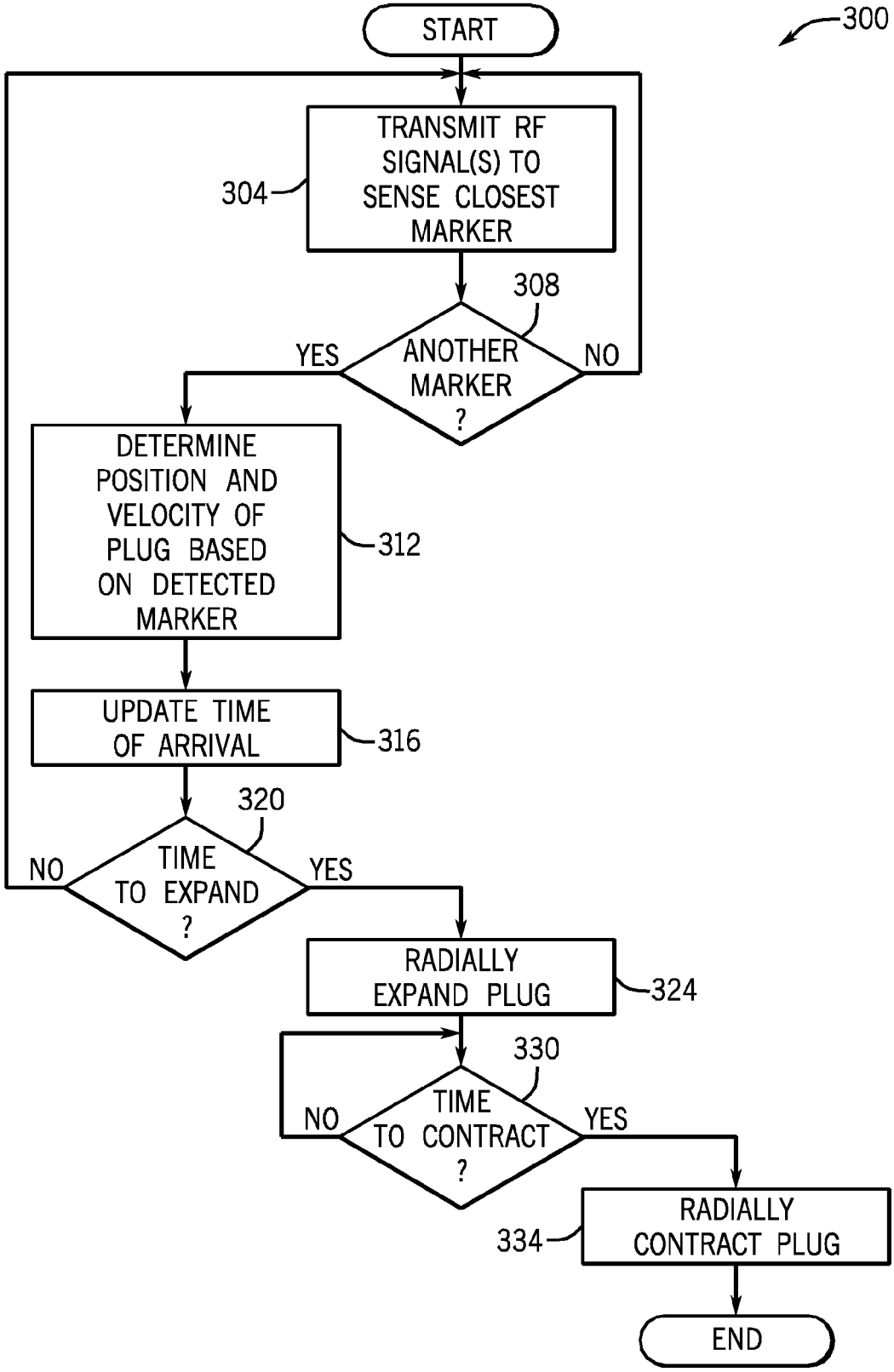
FIG. 9 is a flow diagram depicting a technique used by the plug to autonomously control its operations in the well according to an embodiment of the invention.
Figure 11:
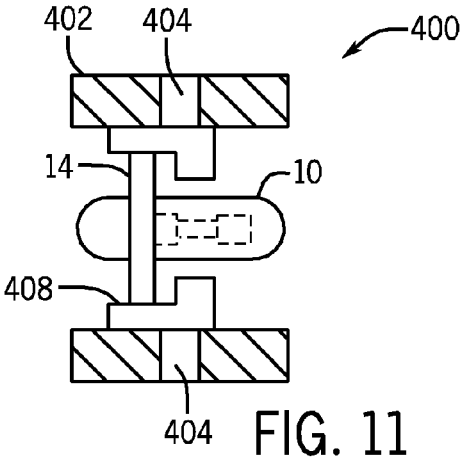
FIGS. 11, 12, 13, 14 and 15 depict a sequence in which the plug is used to open and close flow control ports according to an embodiment of the invention.

More specifically, in accordance with some embodiments of the invention, the plug 10 performs a technique 300 depicted in FIG. 9 for purposes of controlling the radial expansion and contraction of its cross-sectional area. Pursuant to the technique 300, the plug 10 transmits (block 304) at least one RF signal to interrogate the closest location marker and based on these transmitted RF signal(s), determines (diamond 308) whether the plug is approaching, or is near another location marker. If so, the plug 10 determines (block 312) the position and velocity of the plug 10 based on the already detected location markers and correspondingly updates (block 316) the estimated time of arrival at the desired location in the well. If based on this estimated time of arrival, the plug 10 determines (diamond 320) that the plug 10 needs to expand, then the plug radially expands, pursuant to block 324. Otherwise, control returns to block 304, in which the plug 10 senses any additional location markers. After the radial expansion of the plug 10, the plug 10 waits for a predetermined time, in accordance with some embodiments of the invention, to allow desired operations to be conducted in the well, which rely on the zonal isolation. Upon determining (diamond 330) that it is time to contract, then the plug 10 radially contracts to allow its retrieval from the well or its further deployment and possible reuse at another location.

In accordance with other embodiments of the invention, the plug 10 determines whether the plug 10 needs to expand without estimating the time at which the plug 10 is expected to arrive at the desired location. For example, the plug 10 may expand based on sensing a given location marker with knowledge that the given location marker is near the predetermined desired location in the well. In this manner, the given location marker may be next to the desired location or may be, as other non-limiting examples, the last or next-to-last location marker before the plug 10 reaches the desired location. Thus, many variations are contemplated and are within the scope of the appended claims.

In accordance with other embodiments of the invention, the plug 10 may communicate (via acoustic signals, fluid pressure signals, electromagnetic signals, etc.) with the surface or other components of the well for purposes of waiting for an instruction or command for the plug 10 to radially contract. Thus, aspects of the plug's operation may be controlled by wireless signaling initiated downhole or initiated from the Earth surface of the well. Therefore, many variations are contemplated and are within the scope of the appended claims.

Figure 10:
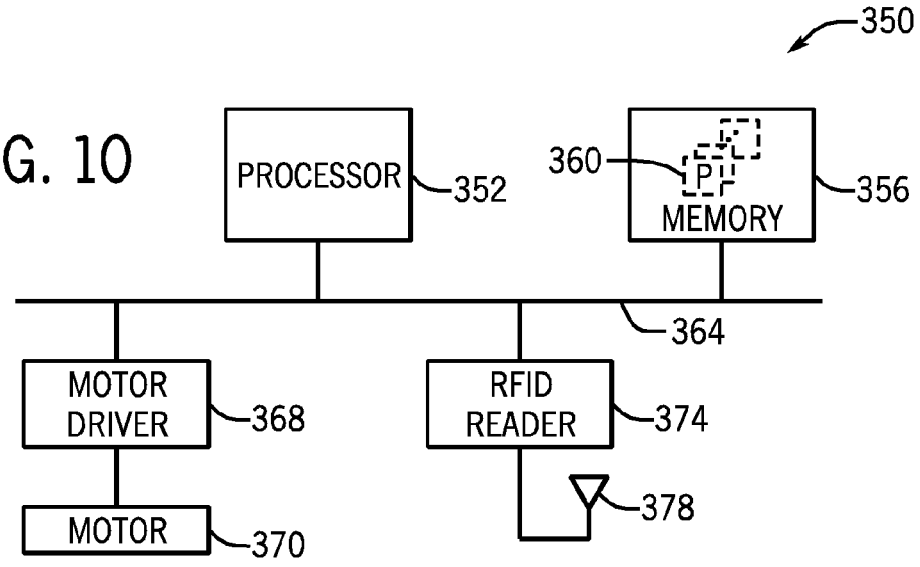
FIG. 10 is a schematic diagram of an architecture employed by the plug according to an embodiment of the invention.

As a general, non-limiting example, FIG. 10 depicts a possible architecture 350 employed by the plug 10 in accordance with some embodiments of the invention. In general, the architecture 350 includes a processor 352 (one or more microcontrollers, central processing units (CPUs), etc.), which execute one or more sets of program instruction 360 that are stored in a memory 356. In general, the architecture 350 includes a bus structure 364, which allows the processor 352 to access a motor driver 368 for purposes of driving a motor 370 to selectively expand and contract the blocker 14. Moreover, in accordance with some embodiments of the invention, the processor 352, by executing the program instructions 360, operates an RFID reader 374 for purposes of generating RF signals, via an antenna 378 for purposes of interrogating RFID tags that are disposed at the location markers in the well and receiving corresponding signals (via the antenna 378, or another antenna, for example) from an interrogated RFID tags. Based on this instruction, the processor 352 may sense proximity to a given location marker. As a non-limiting example, each RFID (in the location marker) may store an ID that is distinct from the IDs stored by the other RFID tags to allow the processor 352 to determine the location of the plug 10, the velocity of the plug 10, etc. The processor 352 may, for example, access a table of locations (stored in the memory 356, for example), which is indexed by IDs to allow the processor 352 to correlate a given location marker (as indicated by a specific ID.)

Figure 12:
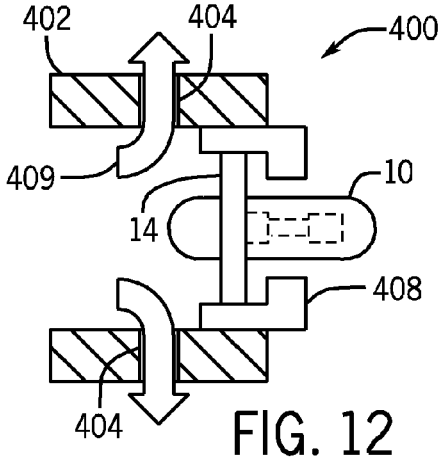
Figure 13:
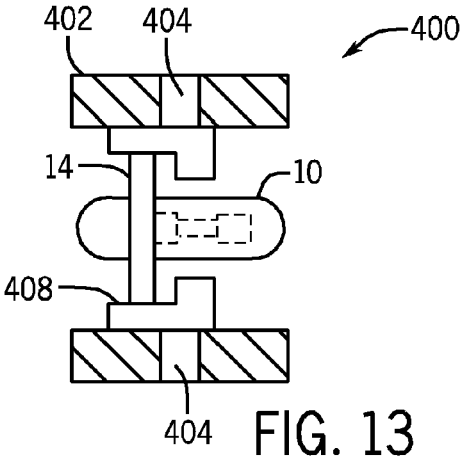
Figure 14:
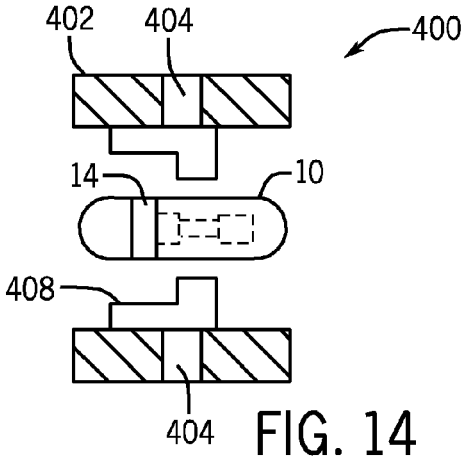
Figure 15:
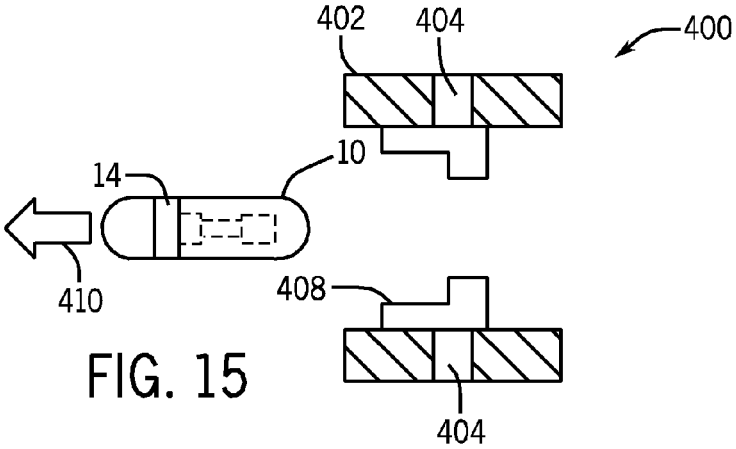

As a non-limiting example, FIGS. 11, 12, 13, 14 and 15 depicts an exemplary, repeatable downhole operation that may be performed using the plug 10, in accordance with some embodiments of the invention. For this example, the plug 10 is radially expanded to lodge the plug 10 within a restricted passageway of a control sleeve 408 of a sleeve valve 400 (see FIG. 11). Thus, fluid pressure may be increased to shift the control sleeve 408 to open fluid communication ports 404 of the valve 400 to communicate a circulation flow 409, as depicted in FIG. 12. Likewise, flow may be reversed in the opposite direction for purposes of using the plug 10 to shift the control sleeve 408 in the opposite direction to close the fluid communication through the ports 404, as depicted in FIG. 13. As shown in FIG. 14, the plug 10 may then be radially contracted to allow the plug 10 to be moved in either direction in the well (either by a forward flow, a reverse flow F, as depicted in FIG. 15, or a gravity caused free falling) for such purposes as operating another valve in the well or possibly retrieving the plug 10 to the Earth's surface.

As an example of another use of the plug 10, the plug may be part of a perforating gun assembly 450, in accordance with some embodiments of the invention. For this non-limiting example, in general, the plug 10 may form the nose of the perforating gun assembly 450, which also includes a perforating gun substring 454 that is attached to the back end of the plug 10*a* and contains perforating charges 455, such as shaped charges. The perforating gun assembly 450 may be flowed in an untethered manner into a downhole cylindrical environment for purposes of performing a perforating operation at a desired downhole location.

Figure 17:
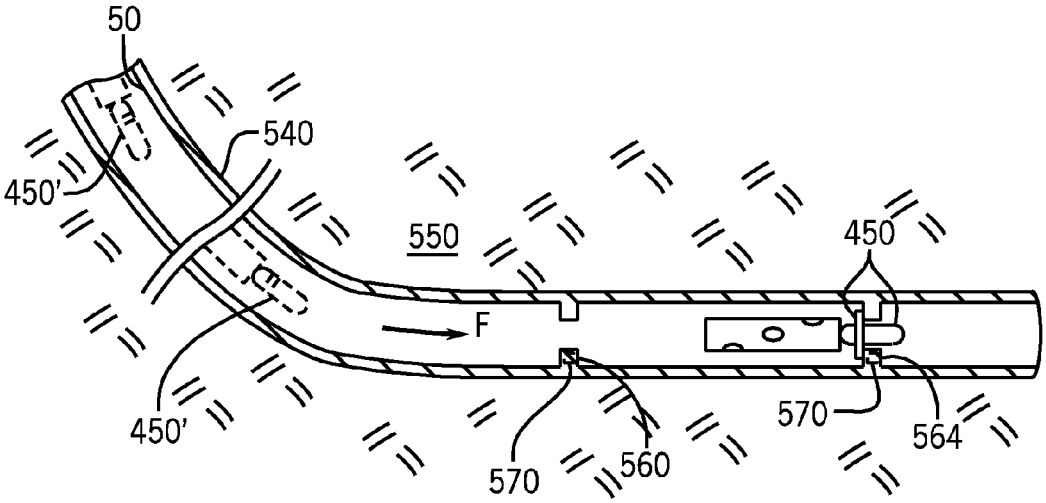
FIGS. 17, 18 and 19 are illustrations of a wellbore depicting a perforating operation conducted using the perforating gun apparatus of FIG. 16 according to an embodiment of the invention.

As a more specific example, FIG. 17 depicts an exemplary wellbore 500 that is cased by a casing string 540 that, in general, lines and supports the wellbore 500 against a surrounding formation 550. For this example, the perforating gun assembly 450 travels through the interior passageway of the casing string 540 via a flow F. Thus, FIG. 17 depicts various intermediate positions 450' of the perforating gun assembly 450 as it travels in its radially contracted state through the passageway of the casing string 540. In its travel, the perforating gun assembly 450 passes and senses at least one location marker, such as marker 560 (containing an RFID tag 570, for example), and based on the detected marker(s), the plug 10 radially expands at the appropriate time so that the perforating gun assembly 450 becomes lodged at a location marker 564. Thus, at the location of the perforating gun assembly 450 depicted in FIG. 17, perforating operations are to be conducted.

Figure 16:
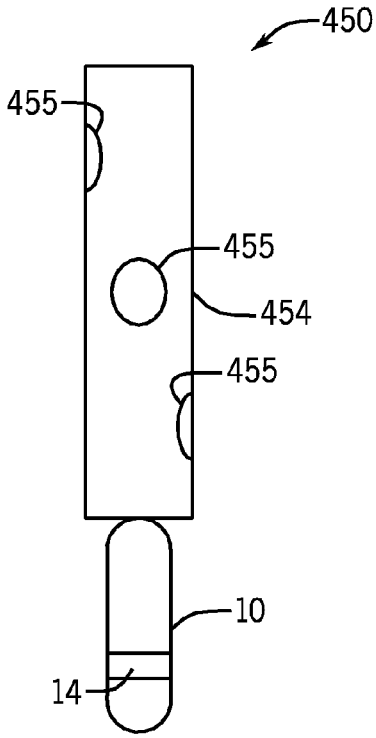
FIG. 16 is an illustration of a perforating gun assembly according to an embodiment of the invention.
Figure 18:
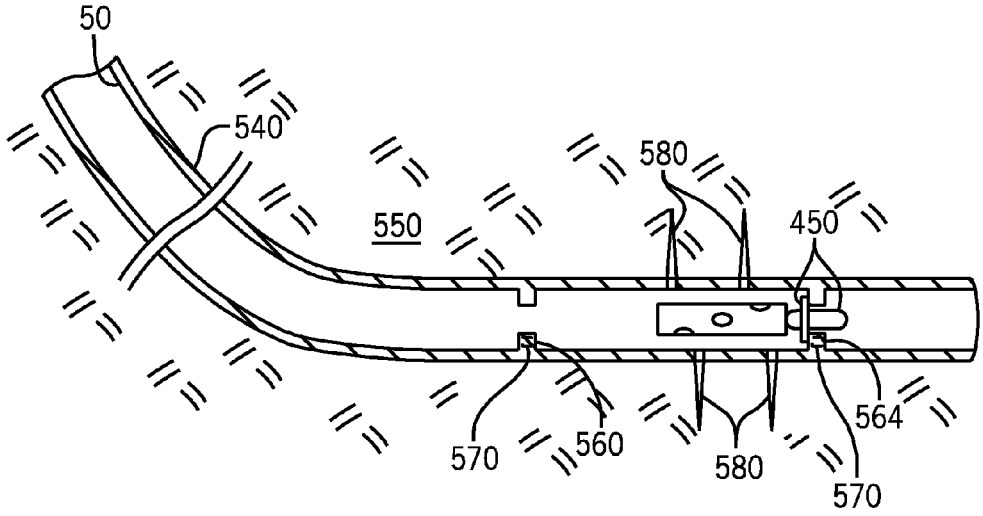
Figure 19:
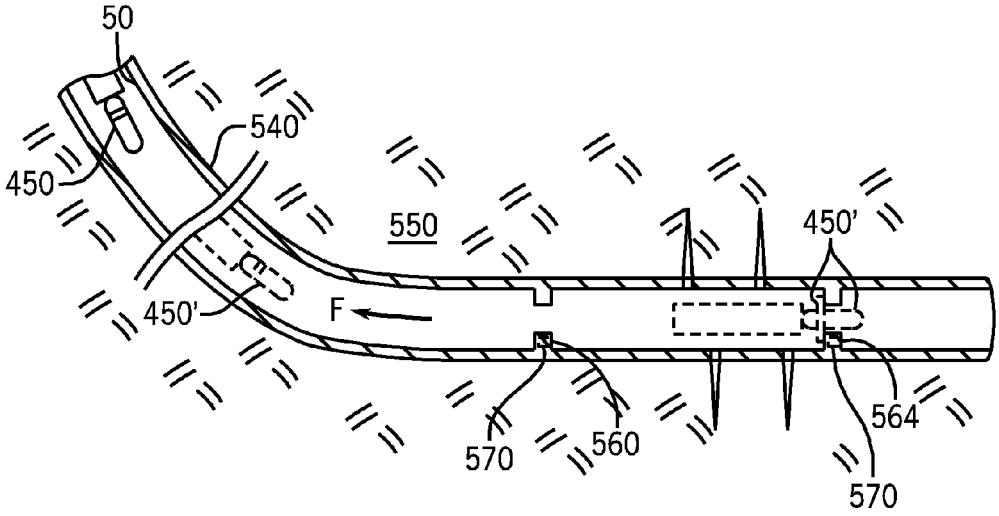

Referring to FIG. 18, for this example, the perforating gun 454 (see FIG. 16) may be a pressure actuated perforating (TCP) gun, and due to the zonal isolation created by the plug 10, fluid pressure inside the casing string 540 may be increased to fire the gun's perforating charges 455. The perforating operation perforates the surrounding casing string 540 and produces corresponding perforation tunnels 580 into the surrounding formation 550. At the conclusion of the perforating operation, the plug 10 radially contract to allow the perforating gun assembly 450 to be flowed in either direction in the well (via a reverse flow F, as depicted in FIG. 19) for such purposes as using unfired charges of the perforating gun assembly 450 to perforate another zone or possibly retrieving the perforating gun assembly 450 to the Earth's surface.

Figure 20:
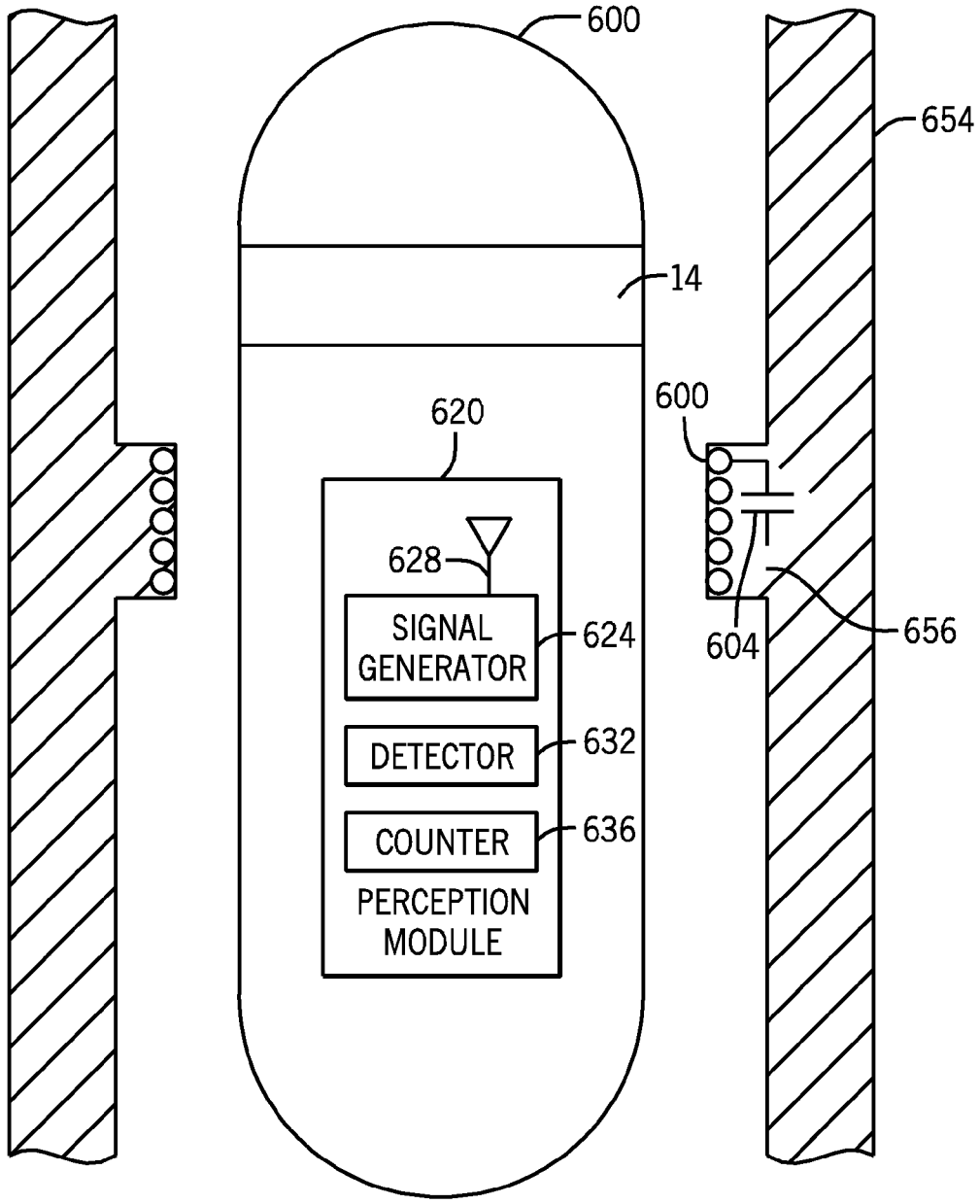
FIG. 20 is an illustration of a wellbore depicting a system for detecting location markers according to another embodiment of the invention.

Other embodiments are contemplated and are within the scope of the appended claims. For example, referring to FIG. 20, in accordance with some embodiments of the invention, an untethered plug 600 may generally contain the features of the plugs disclosed herein, except that the plug 600 has a perception module 620 (replacing the perception module 26) that senses a given location marker by detecting a change in an electromagnetic field signature, which is caused by the presence of the location marker. In this manner, the perception module 620 contains a signal generator 624 (a radio frequency (RF) generator, for example), which generates a signal (an RF signal, for example) that drives an antenna 628 to produce a time changing electromagnetic field. A location marker 656 (in a casing string 654) contains an inductor-capacitor tag, or "LC tag, that is formed from a capacitor 604 and an inductor that influences this electromagnetic field. The inductor may be formed, for example, from a coil 600 of multiple windings of a wire about the inner diameter of the casing string 654 such that the coil 600 circumscribes the longitudinal axis of the string 654.

The inductor and the capacitor 604 of the location marker 656 may be serially coupled together and are constructed to influence the signature of the signal that is produced by the signal generator 624. In other embodiments, the inductor and the capacitor 604 may be coupled together in parallel. When the plug 600 is in the vicinity of the location marker 656, the electromagnetic field that emanates from the plug's antenna 628 passes through the coil 600 to effectively couple the inductor and capacitor 604 to the signal generator 624 and change the signature of the signal that the signal generator 624 generates to drive the antenna 628. A detector 632 of the perception module 620 monitors the signal that is produced by the signal generator 624 for purposes of detecting a signature that indicates that the plug 600 is passing in the proximity of the location marker 656. As non-limiting examples, the signature may be associated with a particular amplitude, amplitude change, frequency, frequency change, spectral content, spectral content change or a combination of one or more of these parameters. Thus, the detector 632 may contain one or more filters, comparators, spectral analysis circuits, etc., to detect the predetermined signature, depending on the particular implementation.

In accordance with some embodiments of the invention, upon detecting the signature, the detector 632 increments a counter 636 (of the perception module 620), which keeps track of the number of detected location markers 656. In this manner, in accordance with some embodiments of the invention, the perception module 620 initiates deployment of the blocker 14 in response to the counter 636 indicating that a predetermined number of the location markers 656 have been detected. In this manner, in accordance with some embodiments of the invention, the LC "tags" in the casing 654 all have the exact same resonance frequency (signature), so the plug 600 counts identical LC tags so that the plug 600 opens the blocker 14 after the plug 600 passes N−1 markers so that the plug 600 locks into the Nth marker. Other variations are contemplated, however. For example, in accordance with other embodiments of the invention, each location marker 656 employs different a different combination of inductance and capacitance. Therefore, the signatures produced by the location markers 656 may be distinctly different for purposes of permitting the detector 632 to specifically identify each location maker 656.

As an example of another embodiment of the invention, the layers 200*a*, 200*b* and 200*c* (see FIGS. 6, 7A and 7B) of the blocker 14 may be biased by resilient members to retract (FIG. 7B). The layers 200*a*, 200*b* and 200*c* may be radially expanded and retracted using a tapered plunger that extends through the central openings of the layers 200*a*, 200*b* and 200*c* to radially expand the layers 200*a*, 200*b* and 200*c* (see FIG. 7A) and retracts from the central openings to allow the layers 200*a*, 200*b* and 200*c* to retract (FIG. 7B). The actuation module 18, for this embodiment, contains a linear motor that is connected to the tapered plunger to selectively drive the plunger in and out of the central openings of the layers 200*a*, 200*b* and 200*c*, depending on whether or not the blocker 14 is to be radially expanded.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

deploying a plurality of location markers in a passageway of the well;

deploying an untethered object in the passageway sized such that the object freely travels downhole via the passageway past at least one of the location markers; and using the untethered object to sense proximity of at least some of the location markers as the object travels downhole and based on the sensing, selectively expand its size to cause the object to become lodged in the passageway near a predetermined location.

2. The method of claim 1, wherein the act of deploying the location markers comprise deploying identifiers near portions of the passageway where the passageway is restricted in size.

3. The method of claim 1, further comprising actuating a motor to rotate a plurality of sealing elements to radially expand the object.

4. The method of claim 1, further comprising:

pressurizing a region in the passageway when the object is lodged to operate a flow control valve or operate a valve adapted to, when open, establish fluid communication between a well bore and a formation.

5. The method of claim 1, further comprising:

pressurizing a region in the passageway when the object is lodged to operate a perforating gun.

6. The method of claim 1, further comprising:

radially contracting the object to dislodge the object from the passageway; and reverse flowing the object out of the passageway.

7. The method of claim 1, wherein the act of using the untethered object comprises using the untethered object to estimate when the untethered object arrives at the predetermined location and regulate its expansion based on the estimate.

8. A method usable with a well, comprising:

deploying a plurality of location markers in a passageway of the well;

deploying an untethered object in the passageway such that the object travels downhole via the passageway;

using the untethered object to sense proximity of at least some of the location markers as the object travels downhole and based on the sensing, selectively expand its size to cause the object to become lodged in the passageway near a predetermined location; and using the object to dislodge itself from the passageway in response to the object determining that a predetermined time interval has elapsed after the object became lodged in the passageway.

9. A method usable with a well, comprising:

deploying a plurality of location markers in a passageway of the well;

deploying an untethered object in the passageway such that the object travels downhole via the passageway;

using the untethered object to sense proximity of at least some of the location markers as the object travels downhole and based on the sensing, selectively expand its size to cause the object to become lodged in the passageway near a predetermined location; and while the object is traveling downhole, using the object to determine a velocity of the object based at least in part on the sensing of said at least one location marker and estimate when the object is to arrive near the predetermined location based at least in part on the determined velocity.

10. A method usable with a well, comprising:

deploying a plurality of location markers in a passageway of the well;

deploying an untethered object in the passageway such that the object travels downhole via the passageway;

using the untethered object to sense proximity of at least some of the location markers as the object travels down hole and based on the sensing, selectively expand its size to cause the object to become lodged in the passageway near a predetermined location; and using the object to recognize said at least one marker by transmitting a signal to interrogate a radio frequency tag associated with the location marker.

11. A method usable with a well, comprising:

deploying a plurality of location markers in a passageway of the well;

deploying an untethered object in the passageway such that the object travels downhole via the passageway;

using the untethered object to sense proximity of at least some of the location markers as the object travels downhole and based on the sensing, selectively expand its size to cause the object to become lodged in the passageway near a predetermined location; and radially contracting the object to dislodge the object from the passageway, allowing the object to be moved further into the passageway from said point near the predetermined location.

12. An apparatus usable with a well, comprising:

a body adapted to freely travel downhole untethered via a passageway of the well;

a blocker adapted to freely travel downhole with the body in a contracted state as the body travels in the passageway, and be selectively radially expanded to lodge the body in the passageway;

a sensor adapted to freely travel downhole with the body and sense at least some of a plurality of location markers disposed along the passageway as the body travels downhole; and a controller adapted to:

freely travel downhole with the body;

based on the sensing, control the blocker to cause the blocker to radially expand as the body is traveling to cause the body to lodge in the passageway near the predetermined location.

13. The apparatus of claim 12, wherein the blocker is adapted to anchor the body and seal off the passageway near the predetermined location.

14. The apparatus of claim 12, wherein the body is adapted to lodge in a control sleeve of the valve such that pressurization of a region in the passageway when the body is lodged in the control sleeve changes a state of a flow control valve.

15. The apparatus of claim 12, further comprising:

a perforating gun attached to the body, the perforating gun being adapted to fire perforating charges in response to pressurization of a region in the passageway when the body is lodge in the passageway.

16. The apparatus of claim 12, wherein the controller is adapted to selectively control the blocker to radially contract the blocker to dislodge the body from the passageway.

17. The apparatus of claim 12, wherein the body comprises a housing to at least partially contain the blocker, the sensor and the controller, and the housing is adapted to be removed by a milling tool to remove the body when lodged in the passageway.

18. An apparatus usable with a well, comprising:

a body adapted to travel downhole untethered via a passageway of the well; a blocker adapted to travel downhole with the body in a contracted state as the body travels in the passageway, and be selectively radially expanded to lodge the body in the passageway;

a sensor adapted to travel downhole with the body and sense at least some of a plurality of location markers disposed along the passageway as the body travels downhole; and a controller adapted to:

travel downhole with the body;

based on the sensing, control the blocker to cause the blocker to radially expand as the body is traveling to cause the body to lodge in the passageway near the predetermined location, wherein the controller is adapted to control the blocker to dislodge the body from the passageway in response to the controller determining that a predetermined time interval has elapsed after the body became lodged in the passageway.

19. An apparatus usable with a well, comprising:

a body adapted to travel downhole untethered via a passageway of the well;

a blocker adapted to travel downhole with the body in a contracted state as the body travels in the passageway, and be selectively radially expanded to lodge the body in the passageway;

a sensor adapted to travel downhole with the body and sense at least some of a plurality of location markers disposed along the passageway as the body travels downhole; and a container adapted to:

travel downhole with the body;

based on the sensing, control the blocker to cause the blocker to radially expand as the body is traveling to cause the body to lodge in the passageway near the predetermined location, wherein the controller, is adapted to determine a velocity of the object based at least in part on the sensing of said at least one location marker and estimate when the object is to arrive near the predetermined location based at least in part on the determined velocity.

20. An apparatus usable with a well, comprising:

a body adapted to travel downhole untethered via a passageway of the well;

a blocker adapted to travel downhole with the body in a contracted state as the body travels in the passageway, and be selectively radially expanded to lodge the body in the passageway;

a sensor adapted to travel downhole with the body and sense at least some of a plurality of location markers disposed along the passageway as the body travels downhole; and a controller adapted to:

travel downhole with the body;

based on the sensing, control the blocker to cause the blocker to radially expand as the body is traveling to cause the body to lodge in the passageway near the predetermined location, wherein the sensor comprises a radio frequency identification tag reader.

21. An apparatus usable with a well comprising:

a body adapted to travel downhole untethered via a passageway of the well;

a blocker adapted to travel downhole with the body in a contracted state as the body travels in the passageway, and be selectively radially expanded to lodge the body in the passageway;

a sensor adapted to travel downhole with the body and sense at least some of a plurality of location markers disposed along the passageway as the body travels downhole; and a controller adapted to:

travel downhole with the body; and based on the sensing, control the blocker to cause the blocker to radially expand as the body is traveling to cause the body to lodge in the passageway near the predetermined location, wherein the blocker comprises a plurality of fingers and a plate to establish a groove and pin relationship with the fingers to radially expand the fingers, and the controller is adapted to energize the motor to cause the motor to rotate the plate relative to the fingers to radially expand the fingers.

22. A system usable with a well, comprising:

a casing string adapted to support a wellbore of the well, the casing string comprising a passageway;

a plurality of location markers deployed along the passageway; and a plug sized to freely travel downhole untethered via the passageway, the plug adapted to:

recognize at least one of the location markers as the plug travels downhole, estimate when the plug is to arrive near a predetermined location in the well based at least in part on recognition of said at least one location marker, and selectively expand its size to cause the plug to become lodged in the passageway near the predetermined location.

* * * * *